US008490302B2

(12) United States Patent
Rosin

(10) Patent No.: US 8,490,302 B2
(45) Date of Patent: Jul. 23, 2013

(54) OPEN-SOLED ARTICLE OF FOOTWEAR

(76) Inventor: Kevin Roger Rosin, Port Washington, WI (US)

( * ) Notice: Subject to any disclaimer, the term of this patent is extended or adjusted under 35 U.S.C. 154(b) by 427 days.

(21) Appl. No.: 12/846,888

(22) Filed: Jul. 30, 2010

(65) Prior Publication Data

US 2012/0023780 A1 Feb. 2, 2012

(51) Int. Cl.
*A43B 13/00* (2006.01)

(52) U.S. Cl.
USPC ..... 36/106; 36/103; 36/11.5

(58) Field of Classification Search
USPC ..... 36/25 R, 11.5, 8.1, 103, 106
See application file for complete search history.

(56) References Cited

U.S. PATENT DOCUMENTS

| | | | | | |
|---|---|---|---|---|---|
| 363,377 | A * | 5/1887 | Faye | 36/3 R |
| 2,884,716 | A * | 5/1959 | Shelare et al. | 36/3 B |
| 3,605,292 | A * | 9/1971 | Goldblatt | 36/8.1 |
| 3,949,493 | A * | 4/1976 | Rhee | 36/2 R |
| 4,168,584 | A * | 9/1979 | Wren et al. | 36/2 R |
| 4,361,912 | A * | 12/1982 | Arthur | 2/18 |
| 4,361,970 | A * | 12/1982 | Wren et al. | 36/106 |
| 4,397,105 | A * | 8/1983 | Richardson | 36/106 |
| 4,525,940 | A * | 7/1985 | Mochizuki | 36/8.1 |
| 5,317,819 | A | 6/1994 | Ellis, III | |
| 6,990,755 | B2 | 1/2006 | Hatfield et al. | |
| 7,290,357 | B2 | 11/2007 | McDonald et al. | |
| 7,739,810 | B2 * | 6/2010 | Luedecke et al. | 36/114 |
| 2005/0262726 | A1 * | 12/2005 | Ferniani et al. | 36/8.1 |
| 2006/0137224 | A1 * | 6/2006 | Song | 36/72 R |
| 2008/0078106 | A1 | 4/2008 | Montgomery | |
| 2008/0127520 | A1 * | 6/2008 | Luedecke et al. | 36/102 |

* cited by examiner

*Primary Examiner* — Marie Patterson

(57) ABSTRACT

An article of footwear having a sole structure with openings formed therethrough is disclosed. The article of footwear includes an upper for receiving a foot of a wearer and a sole structure attached to the upper and positioned generally below the foot. The sole structure has at least one opening formed therein that extends through the sole structure. The at least one opening formed through the sole structure exposes the plantar surface of the foot of the wearer to a ground surface when the article of footwear is worn by the wearer, and is constructed so as to allow contact between the plantar surface of the foot and the ground surface.

17 Claims, 4 Drawing Sheets

OPEN-SOLED ARTICLE OF FOOTWEAR

BACKGROUND OF THE INVENTION

Embodiments of the invention relates generally to the field of footwear and, more particularly, to an article of footwear having a sole structure with openings formed therethrough.

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground. In addition to attenuating ground reaction forces and absorbing energy (i.e., imparting cushioning), the sole structure may provide traction and control potentially harmful foot motion, such as over pronation. Accordingly, the upper and the sole structure operate cooperatively to provide a comfortable structure that is suited for a wide variety of ambulatory activities, such as walking and running The sole structure generally incorporates multiple layers that are conventionally referred to as an insole, a midsole, and an outsole. The insole is a thin, cushioning member located within the upper and adjacent the plantar (lower/bottom) surface of the foot to enhance footwear comfort. The midsole, which is traditionally attached to the upper along the entire length of the upper, forms the middle layer of the sole structure and serves a variety of purposes that include controlling foot motions and providing cushioning. The outsole forms the ground-contacting element of footwear and is usually fashioned from a durable, wear-resistant material that includes texturing to improve traction.

In conventional articles of footwear, the sole structure is formed so as to completely separate a foot of the wearer from the ground. That is, the insole, midsole, and outsole are formed as continuous, or nearly continuous, layers that provide coverage to an entire bottom surface of the foot of the wearer. The foot of the wearer is thus prevented from making direct contact with the ground, as the midsole and outsole separate the foot from the ground in order to provide cushioning, support, and traction to a wearer.

In some instances, however, a wearer may desire to enjoy a more natural, barefoot-like walking experience. For example, hikers may wish to feel the ground beneath them as they walk in order to experience the feel of walking over different terrains or materials, such as leaves, grass, and mud, for example. As another example, golfers may wish to have a greater feel of the ground beneath them in order to achieve greater stability during a golf swing. Conventional items of footwear deprive a wearer from achieving such an experience by completely separating the foot of a wearer from the ground.

Additionally, in some instances, a wearer may also desire to minimize his impact on types of natural terrain. That is, it is recognized that a hiker wearing conventional hard-soled footwear has a more dramatic impact on vegetation and soil than a barefoot hiker. Thus, a hiker may desire to walk barefoot in order to preserve a grassy trail and minimize his or her impact on that trail.

While hiking over certain terrain in a barefoot manner can produce a more enjoyable sensory experience, it is recognized that certain types of surfaces can be difficult to walk over while barefoot. That is, rocky terrain or hard surfaces, such as cement, may be hard on bare feet. Similarly, ground that is extremely hot or cold may cause a hiker to experience discomfort if walking over that surface barefoot. Thus, it is recognized that some form of protection is desirable for a wearer when walking over such terrain.

It would therefore be desirable to have an article of footwear that provides a wearer with the sensory benefits of barefoot walking It would also be desirable for the article of footwear to provide a wearer with some amount of protection from various types of terrain.

BRIEF DESCRIPTION OF THE INVENTION

Embodiments of the invention provide an article of footwear having a sole structure with openings formed therethrough being constructed and sized so as to allow a portion of a foot of a wearer to contact a ground surface.

In accordance with one aspect of the invention, an article of footwear includes an upper for receiving a foot of a wearer and a sole structure attached to the upper and positioned generally below the foot. The sole structure has at least one opening formed therein that extends through the sole structure, with the at least one opening being constructed to allow a portion of the foot of the wearer to contact a ground surface.

In accordance with another aspect of the invention, an article of footwear includes an upper for receiving a foot of a wearer and a sole structure attached to the upper and positioned generally below the foot. The sole structure further includes a heel portion constructed to receive a heel of a wearer, a ball portion constructed to receive a ball of the foot of the wearer, and an opening extending generally between the heel portion and the ball portion in a midfoot region of the sole structure. The sole structure is constructed such that a thickness of the heel and ball portions and a size of the opening provide for a portion of the foot of the wearer to contact a ground surface In accordance with yet another aspect of the invention, a sole structure for an article of footwear includes a plurality of weight bearing portions configured to bear a weight of the wearer and an outer perimeter portion outlining a shape of the sole structure and connecting the plurality of weight bearing portions. At least one opening is formed in the sole structure and is defined by the plurality of weight bearing portions and the outer perimeter portion, with each of the at least one openings being sized so as to allow a portion of a plantar surface of a foot of the wearer to contact a ground surface.

Various other features and advantages will be made apparent from the following detailed description and the drawings.

BRIEF DESCRIPTION OF THE DRAWINGS

The drawings illustrate embodiments presently contemplated for carrying out the invention.

In the drawings.

DETAILED DESCRIPTION OF THE PREFERRED EMBODIMENT

The following discussion and accompanying figures disclose an article of footwear 10 in accordance with embodiments of the present invention. Footwear 10 is depicted in the figures and discussed below as having a configuration that is suitable for athletic activities, particularly hiking or other outdoor wear in a natural environment. The concepts disclosed with respect to footwear 10 may, however, be applied to footwear styles that are specifically designed for a wide range of other athletic or non-athletic activities, including golf, walking, and everyday wear. Accordingly, one skilled in the relevant art will recognize that the concepts disclosed herein may be applied to a wide range of footwear styles and are not meant to be limited to.

Figure 1:
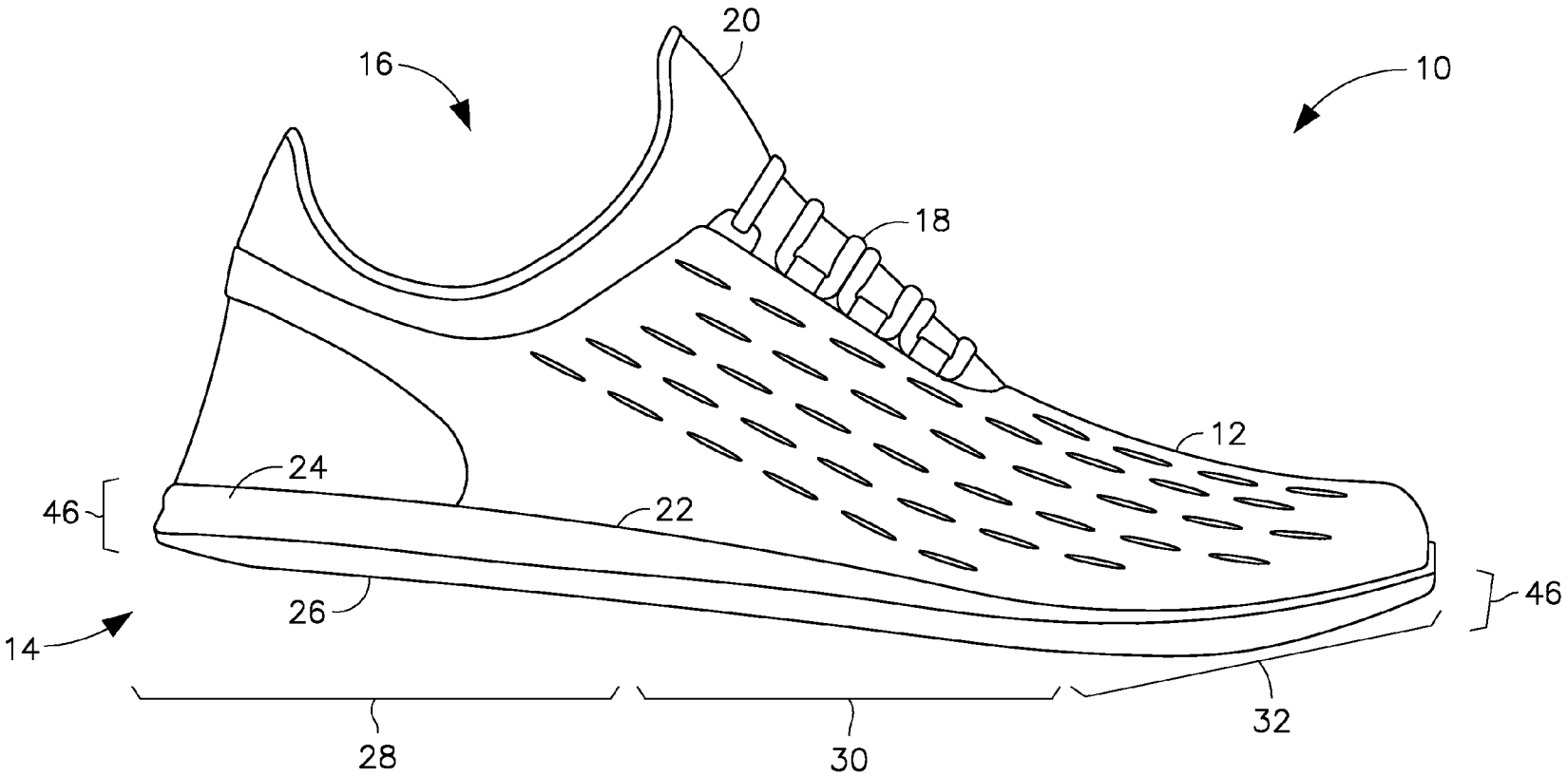
FIG. 1 is a side view of an article of footwear for use with embodiments of the invention.

Referring now to FIG. 1, footwear 10 is depicted and includes an upper 12 and a sole structure 14. Upper 12 is formed from various material elements that are stitched or adhesively-bonded together to form an interior void that comfortably receives a foot and secures the position of the foot relative to sole structure 14. Sole structure 14 is secured to a lower portion of upper 12 and provides a durable, wear-resistant component for attenuating ground reaction forces and absorbing energy (i.e., providing cushioning) as footwear 10 impacts the ground, while also providing for selective portions of a foot to make contact with the surface across which a wearer is walking through the sole structure 14, as will be explained in greater detail below.

The upper 12 forms a void on the interior of the footwear for receiving the foot. The void has the general shape of the foot, and access to the void is provided by an ankle opening 16. Accordingly, the upper 12 extends over the instep and toe areas of the foot, along the medial and lateral sides of the foot, and around the heel area of the foot. A lacing system 18 is often incorporated into the upper 12 to selectively increase the size of the ankle opening 16 and permit the wearer to modify certain dimensions of the upper, particularly girth, to accommodate feet with varying proportions. In addition, the upper 12 may include a tongue 20 that extends under the lacing system 18 to enhance the comfort of the footwear. While a lacing system 18 and tongue 20 are shown as being incorporated into upper 12, it is recognized that alternate features could be implemented therein according to additional embodiments of the invention. For example, a drawstring system or bungee cord type system could replace the lacing system 18, and an upper formed in part of a conformable material, such as neoprene or stretch nylon for example, could obviate the need for a tongue.

The sole structure 14 of footwear 10 includes an insole 22, midsole 24, and outsole 26, that are each formed to provide selective coverage to the plantar (i.e., lower) surface of the foot, as will be explained in greater detail below. Insole 22 is located within the upper 12 and adjacent the plantar surface of the foot to enhance footwear comfort. The midsole 24 is positioned below the insole 22 and provides support and cushioning to wearer, while the outsole 26 forms the ground-contacting element of sole structure 14 and is usually fashioned from a durable, wear-resistant material that includes texturing to improve traction. While sole structure 14 is described as including each of insole 22, midsole 24, and outsole 26, it is recognized that embodiments of the invention may forgo the use of an insole 22 or midsole 24.

For purposes of reference, sole structure 14 may be divided into a number of general regions: a heel region 28, a midfoot region 30, and a forefoot region 32, as defined in FIG. 1. Generally, heel region 28 corresponds to the heel of the wearer, midfoot region 30 corresponds to the metatarsal arch of the wearer, and forefoot region 32 corresponds to the ball and toes of the wearer.

Figure 2:
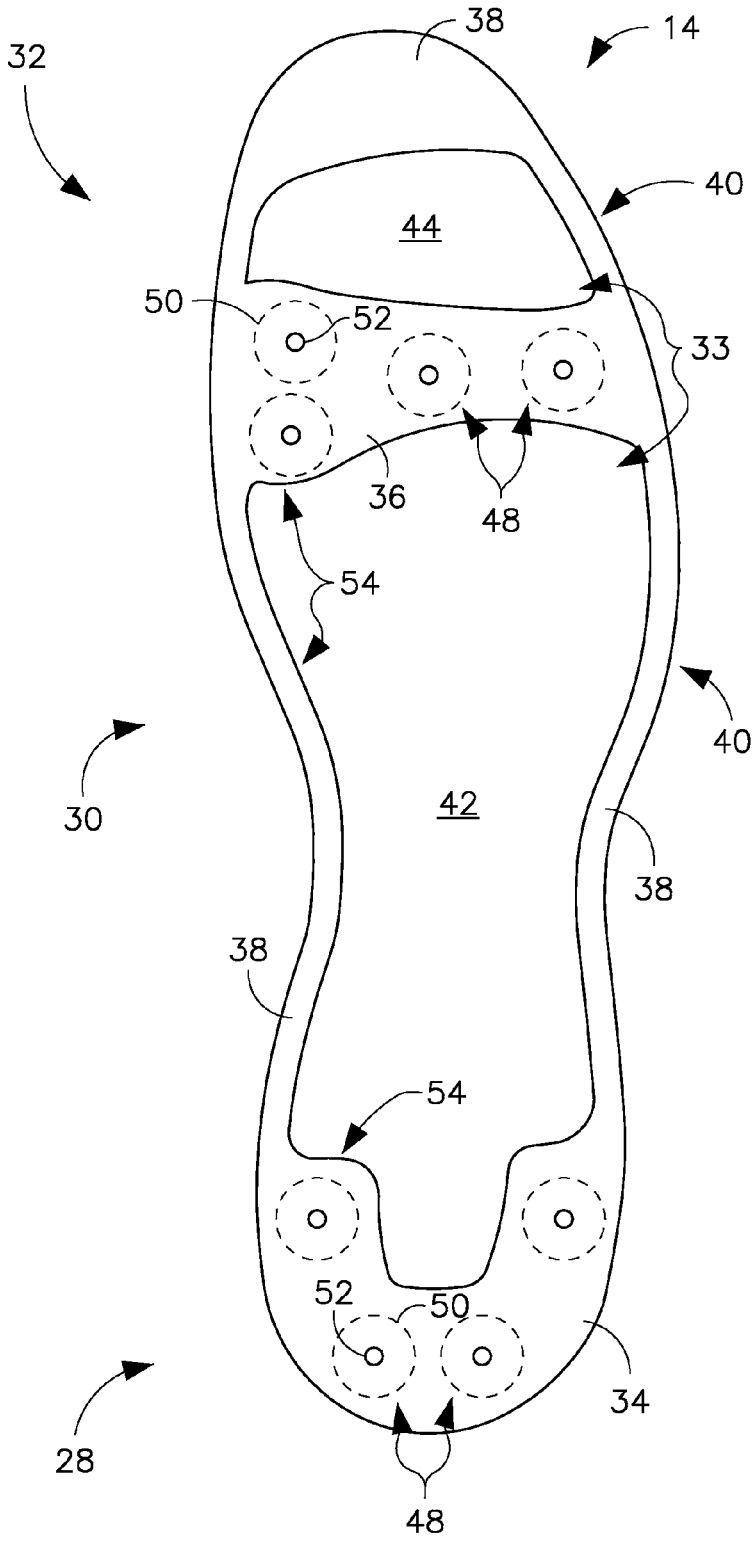
FIG. 2 is a bottom view of the article of footwear of FIG. 1 having a sole structure according to an embodiment of the invention.

Referring now to FIG. 2, a bottom view of the sole structure 14 of the footwear 10 is shown according to an embodiment of the invention. Sole structure 14 is formed such that openings 33 are formed that extend an entirety of the way therethrough so as to expose the bare, plantar surface of the foot to the ground when footwear 10 (FIG. 1) is worn by a wearer. Thus, insole 22, midsole 24, and outsole 26 of sole structure 14 are formed to cover the plantar surface of the foot only in selective locations. As shown in FIG. 2, sole structure 14 is formed to cover the plantar surface of the foot at what are generally considered to be "weight bearing portions" of the foot, those being a heel and ball of the foot of a wearer. Thus, according to an embodiment of the invention, sole structure 14 includes a heel portion 34, generally corresponding to the heel of a wearer, and a ball portion 36, generally corresponding to the ball of the foot of a wearer. Also included in sole structure 14 is an outer perimeter portion 38 that outlines a shape of the sole structure 14. The outer perimeter portion 38 therefore extends forward from the heel portion 34, between the heel portion 34 and the ball portion 36 along a perimeter 40 of the sole structure 14, and also extends forward from the ball portion 36 to define the perimeter 40 of the forefoot region 32 of sole structure 14. According to an embodiment of the invention, a section of outer perimeter portion 38 in midfoot region 30, adjacent an inner edge of the sole structure 14, can be formed as a support arch structure that provides support to the metatarsal arch of the wearer.

According to an embodiment of the invention, and as shown in FIG. 2, an opening 42 (i.e., first opening) is formed in sole structure 14 between heel portion 34 and ball portion 36 (i.e., in midfoot region 30). The opening 42 is thus formed in the sole structure 14 in an area adjacent to a metatarsal arch of the wearer and extends between the heel portion 34 and ball portion 36. The metatarsal arch of the wearer is mainly a non-weight bearing portion of the foot, and thus the need for cushioning in this area is minimized. Opening 42 is sized/constructed so as to allow a portion of the plantar surface of the foot of the wearer to contact a ground surface. According to one embodiment of the invention, heel portion 34 is formed to have a generally U-shaped profile, such that opening 42 extends back into a small area of the heel portion 34. The U-shaped profile of heel portion 34 generally corresponds to the shape of the heel of the wearer, and thus still provides cushioning to the heel of the wearer, while also providing for an increased area of opening 42, to expose more of the plantar surface of the foot to the ground.

As further shown in FIG. 2, an additional opening 44 (i.e., second opening) is formed in sole structure 14 in an area adjacent to a toe portion of the wearer, generally in a portion of the forefoot region 32. That is, opening 44 is formed in sole structure 14 and is positioned forward of ball portion 36, so as to be generally defined by ball portion 36 and that part of outer perimeter portion 38 that defines the perimeter 40 of the forefoot region 32 of sole structure 14. The opening 44 is thus formed in the sole structure 14 in an area adjacent to the toes of the wearer, so as to expose at least a portion of the toes to the ground, and is sized/constructed so as to allow a portion of the plantar surface of the foot of the wearer to contact the ground. Similar to the metatarsal arch, the toes of the wearer are mainly a non-weight bearing portion of the foot, and thus the need for cushioning in this area is minimized.

While openings 42, 44 are shown adjacent the metatarsal arch and the toes, it is recognized that sole structure 14 could include only one of theses openings formed therein. Thus, according to an embodiment of the invention, sole structure 14 could include opening 42 formed therethrough adjacent the metatarsal arch of the wearer, without opening 44 being formed in the sole structure 14. Alternatively, sole structure 14 could include opening 44 formed therethrough adjacent the toes of the wearer, without opening 42 being formed in the sole structure 14.

According to the embodiment of FIG. 2, sole structure 14 thus provides protection to the weight-bearing portions of the foot of the wearer from a ground surface, while also exposing selective, generally non-weight bearing portions of the foot to the ground surface. The weight-bearing heel portion 34, ball portion 36, and outer perimeter portion 38 of the soles are formed of a selectively patterned insole 22, midsole 24, and outsole 26 (FIG. 1) to provide comfort, cushioning, and fraction to a wearer via any of a number of energy/shock absorbent materials in the midsole 24 and durable, wear-resistant materials and patterns on the outsole 26. The openings 42, 44 are selectively formed in sole structure 14 (through the insole, midsole, and outsole) and are sized so as to allow portions of the foot, such as the metatarsal arch and toes, to make bare contact with a ground surface.

To further accommodate and allow for portions of the foot making bare contact with the ground surface, it is recognized that a thickness 46 (FIG. 1) of sole structure 14 should me minimized to the extent possible, while still providing adequate cushioning to a wearer. Thus, for example, a thickness 46 of sole structure 14 could be in the range of 3 mm to 10 mm in thickness. The above cited range is merely exemplary and it is recognized that a sole structure 14 having a lesser or greater thickness 46 is within the scope of the invention, such that it allows for portions of the foot making bare contact with the ground surface. Additionally, it is recognized that sole structure 14 can be constructed so as to conform to the contours of the plantar surface of the foot of the wearer, so as to further provide for a barefoot type walking experience and accommodate portions of the foot making bare contact with the ground surface.

Referring still to FIG. 2, according to one embodiment of the invention, heel portion 34 and ball portion 36 of sole structure 14 each include a plurality of apertures 48 formed therethrough, extending through the insole 22, midsole 24, and outsole 26 of the heel portion 34 and ball portion 36. Apertures 48 are small in size as compared to openings 42, 44, and according to an exemplary embodiment, are approximately 1 cm in diameter or less, for example, so as to not detract from the cushioning properties of heel portion 34 and ball portion 36. Apertures 48 function to drain water, small pebbles, dirt, sand, etc., that may have become trapped between a plantar surface of the foot and the heel and ball portions 34, 36 of sole structure 14. As such, apertures 48 may have a funnel shape, with a wider opening 50 (shown in phantom) formed adjacent insole 22, and funneling down to a narrower opening 52 exiting outsole 26, so as to promote removal of water, pebbles, dirt, etc.

According to one embodiment of the invention, as a further protection against small pebbles, dirt, sand, etc., becoming trapped between a plantar surface of the foot and the heel and ball portions 34, 36 of sole structure 14, inner edges 54 of heel portion 34, ball portion 36, and outer perimeter portion 38 adjacent to/defining openings 42, 44 may be curved in shape. That is, inner edges 54 may be constructed to curve upward toward the foot of a wearer in order to form a barrier between edges 54 and the foot of the wearer.

Figure 3:
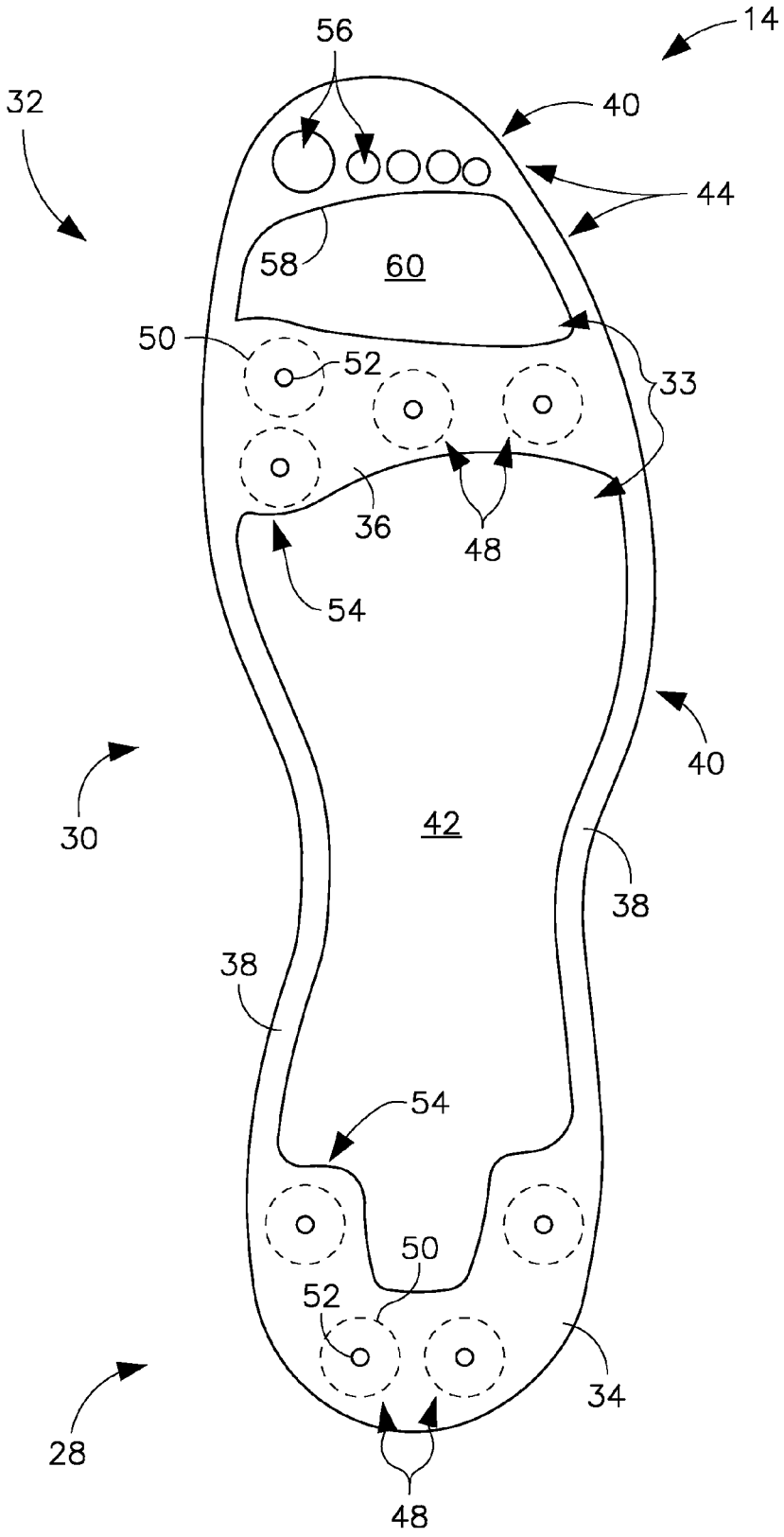
FIG. 3 is a bottom view of the article of footwear of FIG. 1 having a sole structure according to an embodiment of the invention.

Referring now to FIG. 3, according to another embodiment of the invention, sole structure 14 is provided where "opening 44" is formed as a plurality of openings between ball portion 36 and that part of outer perimeter portion 38 that defines the perimeter 40 of the forefoot region 32. That is, as shown in FIG. 3, opening 44 includes multiple toe openings 56 corresponding to the toes of the wearer. Thus, five toe openings 56 would be formed through sole structure 14, being defined by a toe sole portion 58 of the sole structure 14. An additional opening 60 is also formed in sole structure 14 between ball portion 36 and toe sole portion 58, according to an embodiment of the invention, thereby exposing more of the plantar surface of the foot to the ground.

According to an embodiment of the invention, sole structure 14 can be constructed such that toe sole portion 58 is generally divided into five separate portions that are generally shaped to conform to the toes of the wearer. That is, toe sole portion 58 may be constructed such that the insole 22 (FIG. 1) may be shaped to generally conform to the toes of the wearer and, additionally, the outsole 26 (FIG. 1) may be contoured on a bottom surface thereof to have a shape generally matching that of the toes of the wearer.

Figure 4:
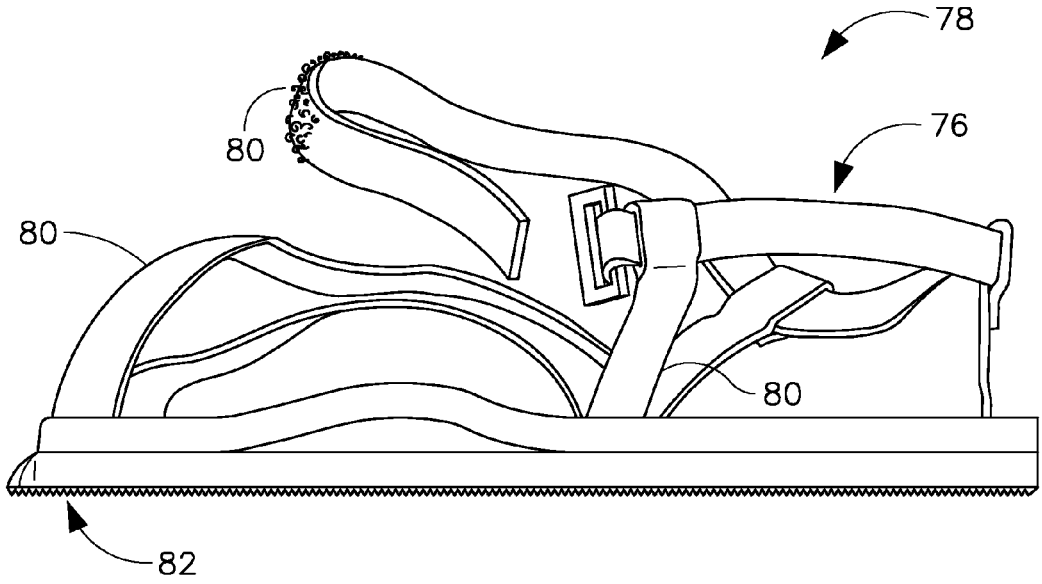
FIG. 4 is a side view of an article of footwear for use with embodiments of the invention.
Figure 5:
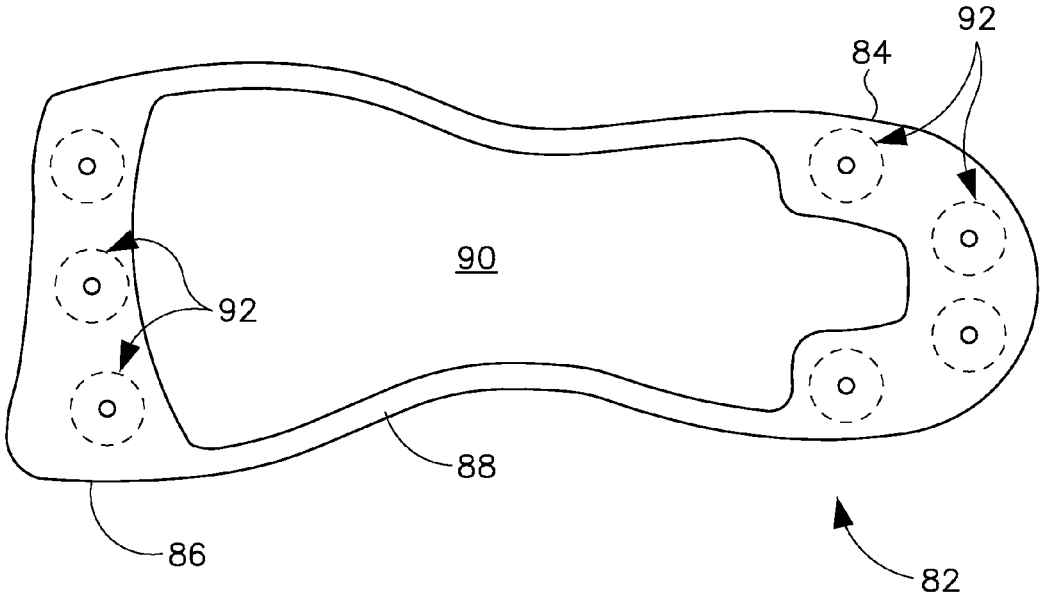
FIG. 5 is a bottom view of the article of footwear of FIG. 4 having a sole structure according to an embodiment of the invention.

An additional embodiment of the invention is shown in FIGS. 4 and 5, where an upper 76 of an article of footwear 78 is configured as a sandal-type upper, and thus is comprised of a plurality of straps 80 that selectively receive and secure the foot of a wearer. A sole structure 82 is attached to upper 76 and includes a plurality of weight-bearing portions, including a heel portion 84, generally corresponding to the heel of a wearer, and a ball portion 86, generally corresponding to the ball of the foot of a wearer. Also included in sole structure is an outer perimeter portion 88 that outlines a shape of the sole structure 82. The outer perimeter portion 88 therefore extends forward from the heel portion 84, between the heel portion 84 and the ball portion 86 along an outer edge of the sole structure 82.

An opening 90 is formed in sole structure 82 between heel portion 84 and ball portion 86. The opening 90 is thus formed in the sole structure 82 in an area adjacent to a metatarsal arch of the wearer, exposing at least of portion of the metatarsal arch of the foot to the ground. Additionally, a plurality of apertures 92 are formed through sole structure 82 that are sized to provide for drainage/removal of water, small pebbles, dirt, sand, etc., that may have become trapped between a plantar surface of the foot and the heel and ball portions 86, 88 of sole structure 14.

As shown in the embodiment of FIGS. 4 and 5, sole structure 82 ends at ball portion 86, and does not extend further forward. Thus, a "forefoot region" of sole structure 82 is cut off at ball portion 86. Removal of such a forefoot region from footwear 78 allows for an even greater portion of the foot of the wearer to make bare contact with the ground surface, as the toes of a wearer will be completely exposed for making contact with the ground surface.

While embodiments of sole structure described above are detailed as including an insole, midsole, and outsole, it is recognized that such a construction is meant to be only an exemplary embodiment. According to embodiments of the invention, a sole structure, or portions thereof, may not include each of an insole, midsole, and outsole (e.g., sole structure may only include an outsole and an insole/footbed). As such embodiments of the invention are not meant to be limited to a sole structure having each of an insole, midsole, and outsole.

Additionally, it is recognized that further features could be added to sole structure 14 to accommodate different uses for footwear 10. For example, heel portion 34 and ball portion 36 of sole structure 14 could also include a plurality of spikes (e.g., golf soft-spikes) that provide traction to a wearer. Such spikes could be designed to have a low profile so as not to extend out a great distance from sole structure 14, thereby still permitting portions of the plantar surface of the foot (i.e., the metatarsal arch and toes) to make contact with the ground, and could be selectively located on the heel and ball portions 36, 38 to provide optimal stability and traction with a ground surface during movement of a wearer, such as during a golf swing.

Therefore, according to one embodiment of the invention, an article of footwear includes an upper for receiving a foot of a wearer and a sole structure attached to the upper and positioned generally below the foot. The sole structure has at least one opening formed therein that extends through the sole structure, with the at least one opening being constructed to allow a portion of the foot of the wearer to contact a ground surface.

According to another embodiment of the invention, an article of footwear includes an upper for receiving a foot of a wearer and a sole structure attached to the upper and positioned generally below the foot. The sole structure further includes a heel portion constructed to receive a heel of a wearer, a ball portion constructed to receive a ball of the foot of the wearer, and an opening extending generally between the heel portion and the ball portion in a midfoot region of the sole structure. The sole structure is constructed such that a thickness of the heel and ball portions and a size of the opening provide for a portion of the foot of the wearer to contact a ground surface According to yet another embodiment of the invention, a sole structure for an article of footwear includes a plurality of weight bearing portions configured to bear a weight of the wearer and an outer perimeter portion outlining a shape of the sole structure and connecting the plurality of weight bearing portions. At least one opening is formed in the sole structure and is defined by the plurality of weight bearing portions and the outer perimeter portion, with each of the at least one openings being sized so as to allow a portion of a plantar surface of a foot of the wearer to contact a ground surface.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An article of footwear comprising:

an upper for receiving a foot of a wearer; and a sole structure attached to the upper and positioned generally below the foot, the sole structure having at least one opening formed therein extending through the sole structure and being constructed to allow a portion of the foot of the wearer to contact a ground surface;

wherein the sole structure comprises:

a heel portion configured to receive a heel of a wearer and cover at least a portion thereof so as to provide cushioning and protection to the heel of the wearer; and ball portion configured to receive a ball of the foot of the wearer and cover at least a portion thereof so as to provide cushioning and protection to the ball of the foot of the wearer; and wherein the at least one opening comprises an opening formed in a midfoot region of the sole structure, between the heel portion and the ball portion, in an area adjacent to a metatarsal arch of the wearer.

2. The article of footwear of claim 1 wherein the heel portion comprises a U-shaped portion having an opening formed in an interior area thereof.

3. The article of footwear of claim 1 wherein each of the heel portion and the ball portion include a plurality of apertures formed therethrough.

4. The article of footwear of claim 3 wherein each of the plurality of apertures comprises a funnel shaped aperture funneling from a wider aperture opening formed in a top surface of the sole structure to a narrower aperture opening formed in a bottom surface of the sole structure.

5. The article of footwear of claim 1 wherein the sole structure comprises an outer perimeter portion outlining a shape of the sole structure, the outer perimeter portion extending between the heel portion and the ball portion and extending forward from the ball portion to define a front edge of the sole structure.

6. The article of footwear of claim 5 wherein inner edges of the heel portion, ball portion, and outer perimeter portion defining each of the at least one openings are constructed to curve upward toward the foot of the wearer.

7. The article of footwear of claim 1 wherein the sole structure terminates at the ball portion, such that toes of the wearer are exposed to the ground surface.

8. The article of footwear of claim 1 wherein the at least one opening comprises an opening formed in a forefoot region of the sole structure in an area adjacent to toes of the wearer.

9. The article of footwear of claim 8 wherein the opening formed in the forefoot region of the sole structure comprises a plurality of openings, the plurality of openings including at least a respective toe opening corresponding to each toe of the wearer.

10. The article of footwear of claim 1 wherein the sole structure has a thickness of between 3 and 10 mm, so as to be configured to allow a portion of the foot of the wearer to contact a ground surface through the at least one opening.

11. An article of footwear comprising:

an upper for receiving a foot of a wearer; and a sole structure attached to the upper and positioned generally below the foot, the sole structure comprising:

a heel portion constructed to receive a heel of a wearer and cover a majority of the heel of the wearer;

a ball portion constructed to receive a ball of the foot of the wearer and cover a majority of the ball of the foot of the wearer; and an opening extending generally between the heel portion and the ball portion in a midfoot region of the sole structure;

wherein the sole structure is constructed such that a size of the opening provides for a portion of the foot of the wearer to contact a ground surface.

12. The article of footwear of claim 11 wherein the sole structure further comprises an outer perimeter portion outlining a shape of the sole structure, the outer perimeter portion extending between the heel portion and the ball portion and extending forward from the ball portion to define a front edge of the sole structure.

13. The article of footwear of claim 12 wherein the sole structure includes at least one additional opening formed therethrough, the at least one additional opening being formed in the sole structure between the ball portion and the outer perimeter portion defining the front edge of the sole in an area adjacent to a toe portion of the wearer, the at least one additional opening being sized to provide for a portion of the foot of the wearer to contact a ground surface.

14. The article of footwear of claim 11 wherein each of the heel portion and the ball portion has a plurality of apertures formed therein configured to provide for drainage of water and dirt therethrough.

15. A sole structure for an article of footwear comprising:

a plurality of weight bearing portions configured to bear a weight of the wearer, the plurality of weight bearing portions including:

a heel portion configured to receive a heel of the foot of the wearer and provide cushioning and protection to the heel of the wearer; and a ball portion configured to receive a ball of the foot of the wearer and provide cushioning and protection to the ball of the foot of the wearer; and an outer perimeter portion outlining a shape of the sole structure and connecting the heel portion and the ball portion;

wherein at least one opening is formed in the sole structure and is defined by the plurality of weight bearing portions and the outer perimeter portion, each of the at least one openings being sized so as to allow a portion of a plantar surface of a foot of the wearer to contact a ground surface.

16. The sole structure of claim 15 wherein the at least one opening comprises:

a first opening formed through the sole structure between the heel portion and the ball portion and covering a majority of an area therebetween; and a plurality of openings formed through the sole structure forward of the ball portion and distal from the heel portion, the plurality of openings including at least an opening corresponding to each toe of a wearer.

17. The sole structure of claim 15 wherein the plurality of weight bearing portions and the outer perimeter portion have a thickness of between 3 and 10 mm, so as be configured to allow a portion of the plantar surface of the foot of the wearer to contact the ground surface through the at least one opening.

* * * * *